US006908397B2

(12) United States Patent
Armbruster et al.

(10) Patent No.: US 6,908,397 B2
(45) Date of Patent: Jun. 21, 2005

(54) INFANT SUPPORT STRUCTURE WITH AN ENTERTAINMENT DEVICE

(75) Inventors: Michael D. Armbruster, Buffalo, NY (US); Ronald M. Asbach, Grand Island, NY (US); Jennifer A. Schroth, Buffalo, NY (US); Maarten Van Huystee, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/402,141

(22) Filed: Mar. 31, 2003

(65) Prior Publication Data

US 2004/0259648 A1 Dec. 23, 2004

(51) Int. Cl.[7] ..... A63G 9/16
(52) U.S. Cl. ..... 472/119; 472/227; 472/93.1
(58) Field of Search ..... 472/118–125; 446/227, 153, 156, 166, 167; 5/93.1, 93.2, 101

(56) References Cited

U.S. PATENT DOCUMENTS

| | | | | |
|---|---|---|---|---|
| 925,209 | A | | 6/1909 | Livermore |
| 1,838,215 | A | | 12/1931 | De Clairmont |
| 2,595,085 | A | | 4/1952 | Kuriyama |
| 3,762,084 | A | | 10/1973 | Jones |
| 4,223,471 | A | | 9/1980 | Greenberg |
| 4,588,618 | A | | 5/1986 | Wolfe |
| 4,967,694 | A | | 11/1990 | Waldman |
| 4,990,118 | A | | 2/1991 | Shiina |
| 5,017,171 | A | | 5/1991 | Shiina |
| 5,092,065 | A | | 3/1992 | Teng |
| 5,301,444 | A | | 4/1994 | Horiuchi |
| 5,307,531 | A | * | 5/1994 | Kao ..... 5/108 |
| 5,349,771 | A | | 9/1994 | Burnett |
| 5,463,826 | A | | 11/1995 | Horiuchi |
| 5,553,337 | A | * | 9/1996 | Lin ..... 5/93.2 |
| 5,694,655 | A | * | 12/1997 | Shepler et al. ..... 5/105 |
| 5,704,313 | A | | 1/1998 | Gibbs |
| D400,619 | S | | 11/1998 | Schultheis et al. |
| 5,897,197 | A | | 4/1999 | Lin |
| 5,967,639 | A | | 10/1999 | Shih |
| D416,292 | S | | 11/1999 | Hsieh |
| 6,065,850 | A | | 5/2000 | Chiu |
| 6,113,455 | A | | 9/2000 | Whelan et al. |
| 6,131,318 | A | | 10/2000 | Hsieh |
| 6,339,855 | B1 | * | 1/2002 | Socha et al. ..... 5/93.1 |
| 6,464,594 | B1 | * | 10/2002 | Canna et al. ..... 472/119 |

OTHER PUBLICATIONS

Unknown catalog excerpt illustrating "Inquarium™" product, 1969.

* cited by examiner

*Primary Examiner*—Kien Nguyen
(74) *Attorney, Agent, or Firm*—Cooley Godward LLP

(57) ABSTRACT

An infant support structure with an entertainment device that may be used to pacify and/or entertain an infant is disclosed. In one embodiment, the infant support structure is an infant swing. In one embodiment, the entertainment device includes a toy aquarium. The entertainment device may be removably coupled to the infant support structure.

22 Claims, 11 Drawing Sheets

INFANT SUPPORT STRUCTURE WITH AN ENTERTAINMENT DEVICE

BACKGROUND OF THE INVENTION

This invention relates generally to an infant support structure, and in particular, to an infant support structure that includes an entertainment device.

Conventional infant support structures may be used to pacify and relax infants. Some conventional infant support structures include activity components that provide entertainment to an infant supported by the infant support structure. Such conventional activity components include some form of output to attract and retain the attention of the infant. However, infants quickly become disinterested in conventional activity components.

A need exists for an infant support structure with an entertainment device that stimulates the senses of the infant. A need also exists for an entertainment device that moves as the infant support structure moves.

SUMMARY OF THE INVENTION

The invention relates to an infant support structure that may be used to pacify and/or entertain an infant. In one embodiment, the infant support structure is an infant swing. The infant support structure includes an entertainment device. In one embodiment, the entertainment device is a toy aquarium.

In one embodiment, the entertainment device includes an output generating system. In another embodiment, the entertainment device includes an illumination device or light source, such as a lamp or a bulb, which illuminates a portion of the entertainment device. In another embodiment, the entertainment device includes an illumination device that produces light in different colors. In another embodiment, the entertainment device includes an audio output generating system that generates audio outputs, such as music and sound effects.

DETAILED DESCRIPTION OF THE INVENTION

The invention relates to an infant support structure that may be used to pacify and/or entertain an infant. In one embodiment, the infant support structure is an infant swing. The infant support structure includes an entertainment device. In one embodiment, the entertainment device is a toy aquarium.

In one embodiment, the entertainment device includes an output generating system. In another embodiment, the entertainment device includes an illumination device or light source, such as a lamp or a bulb, which illuminates a portion of the entertainment device. In another embodiment, the entertainment device includes an illumination device that produces light in different colors. In another embodiment, the entertainment device includes an audio output generating system that generates audio outputs, such as music and sound effects.

Figure 1:
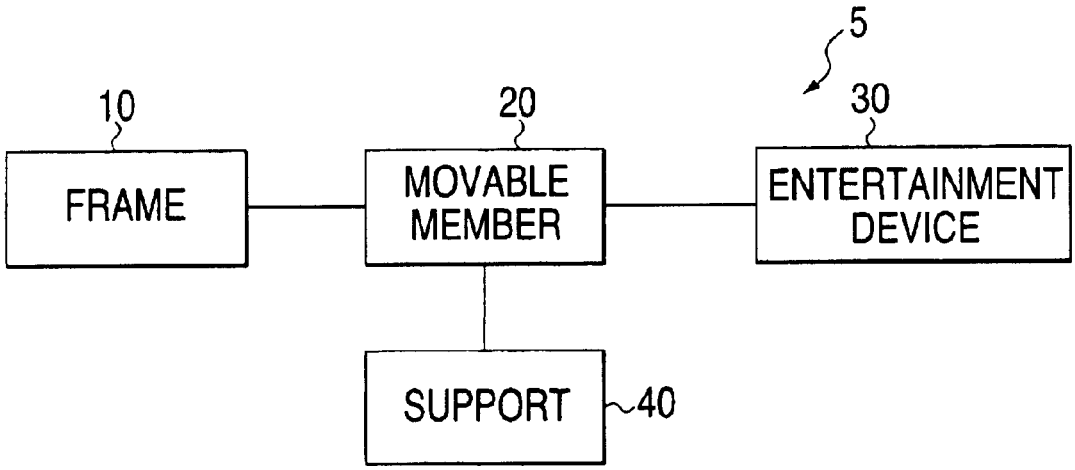
FIG. 1 illustrates a schematic view of an infant support structure according to the invention.

A schematic view of an embodiment of an infant support structure according to the invention is illustrated in FIG. 1. In this embodiment, the infant support structure 5 includes a frame 10 and a movable member 20 coupled to the frame 10. The frame 10 is configured to be supported on a support surface. The infant support structure 5 includes an entertainment device 30 coupled to the movable member 20 and a support 40 coupled to the movable member 20.

The frame 10 can have any configuration that can support the support 40 via the movable member 20. Similarly, the support 40 can be any type of support that can support an infant. For example, the frame 10 and the support 40 can be components of any type of infant support structure, such as a bouncer, a high chair, a stroller, a swing, a crib, a rocker, a play yard, or any other structure that can be used to support an infant.

In one implementation, the infant support structure 5 can be an infant swing in which the frame 10 is an infant swing frame and the support 40 is a seat for the swing. In this example, the support 40 can include a hanger or support arm that is coupled to the movable member 20 for movement relative to the frame 10.

The movable member 20 can be any structure that movably couples the support 40 to the frame 10. For example, the movable member 20 can be a hub or coupler that is coupled to the support 40 and pivotally coupled to the frame 10.

The entertainment device 30 can be disposed at any location on the infant support structure 5. In particular, the entertainment device 30 can be coupled to any part of the infant support structure 5 that moves with respect to a support surface.

In one embodiment, the entertainment device 30 is coupled to the movable member 20. As the movable member 20 moves relative to the frame 10, the entertainment device 30 and the support 40 move with the movable member 20. In an alternative embodiment, the entertainment device 30 can be coupled to part of the support 40. For example, the entertainment device 30 can be coupled to the support arms, a portion of a seat, a portion of a tray, etc.

The entertainment device 30 can include a movable component. The movable component can be fluid or a solid structure that is configured to move relative to a portion of the entertainment device as the entertainment device 30 moves. Thus, as the support 40 moves relative to the frame 10, the movable component of the entertainment device 30 moves.

In one embodiment, the entertainment device 30 is a toy aquarium. The toy aquarium can include a fluid that moves as the support 40 moves. In another embodiment, the toy aquarium can include one or more toy characters that move as the support 40 moves. The fluid and/or the toy characters can be referred to as movable components.

An embodiment of an infant support structure according to the invention is illustrated in FIGS. 2–6. In this embodiment, the infant support structure 100 includes a frame 102. The frame 102 includes an upper portion 110 with legs 112 and 114 and a lower portion 120 with legs 122 and 124. The frame 102 is selectively disposable in a deployed configuration and in a collapsed configuration. In alternative embodiments, the frame 102 can have any configuration and any combination of legs.

A support structure 116, such as a fabric web, is coupled between legs 112 and 114. The web 116 is a fabric member that is coupled to legs 112 and 114 using any conventional technique, such as sewing, hook and loop fasteners, adhesives, etc. The web 116 includes a storage pocket in which various articles can be stored.

Figure 2:
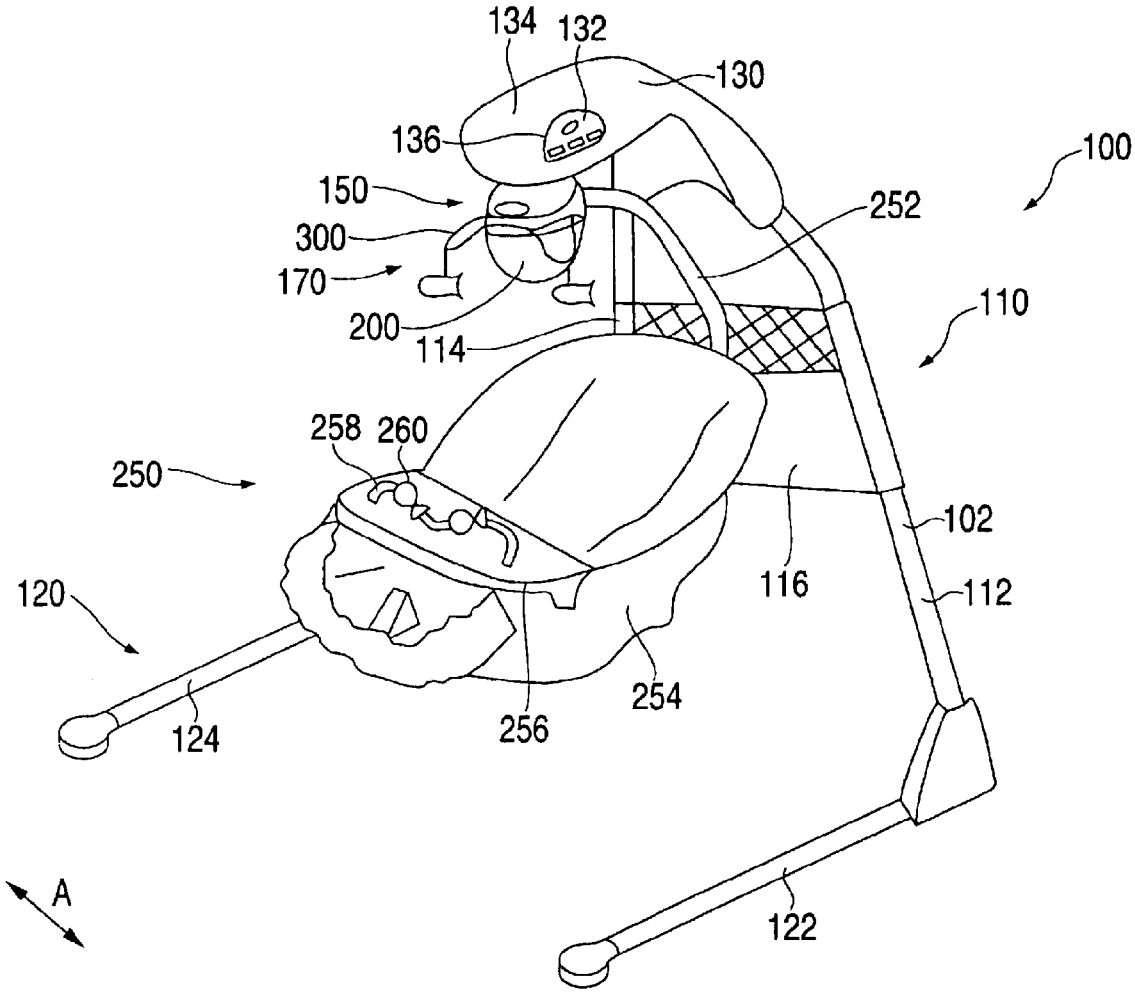
FIG. 2 illustrates a front perspective view of an embodiment of an infant support structure according to the invention.

The frame 102 includes a housing 130. As illustrated in FIG. 2, the housing 130 is coupled to the upper ends of legs 112 and 114. In one embodiment, the housing 130 includes two parts that are coupled to each other using conventional fasteners, such as screws or bolts. The housing 130 defines two openings into which the upper ends of the legs 112 and 114 are disposed. The housing 130 and the legs 112, 114, 122 and 124 of the frame 102 form a structure for an infant support such as a seat. The housing 130 limits the travel of the legs.

Figure 3:
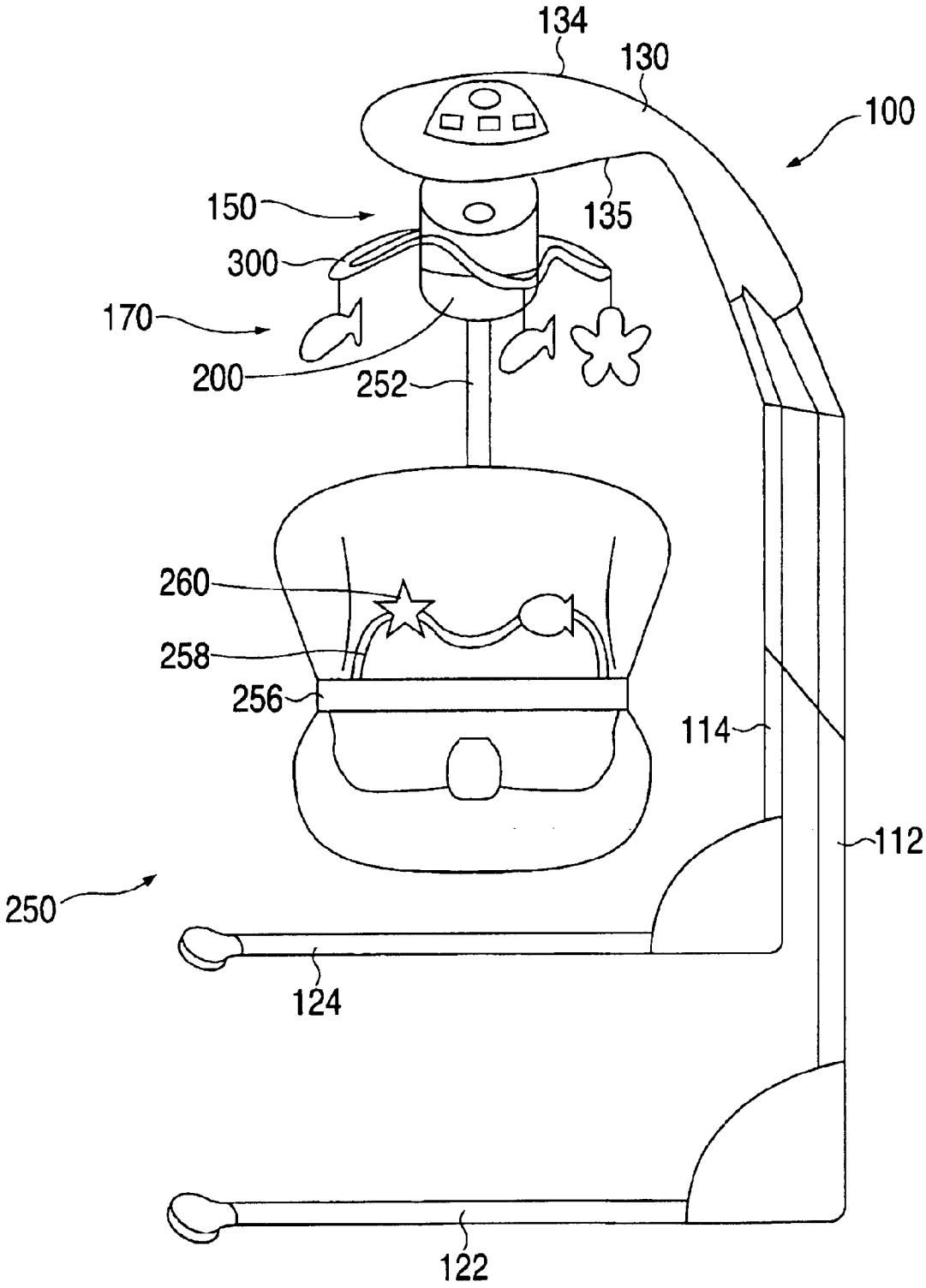
FIG. 3 illustrates a side view of the infant support structure of FIG. 2 in an alternative configuration.

The housing 130 has an upper surface 134 and a lower surface 135 (see FIG. 3). The housing 130 includes a control panel 132 located in an opening 136 formed in the upper surface 134 of the housing 130. The control panel 132 is connected to an electronic system that controls a drive mechanism of the support structure 100 and an output generating system, the function of which is discussed below.

Figure 4:
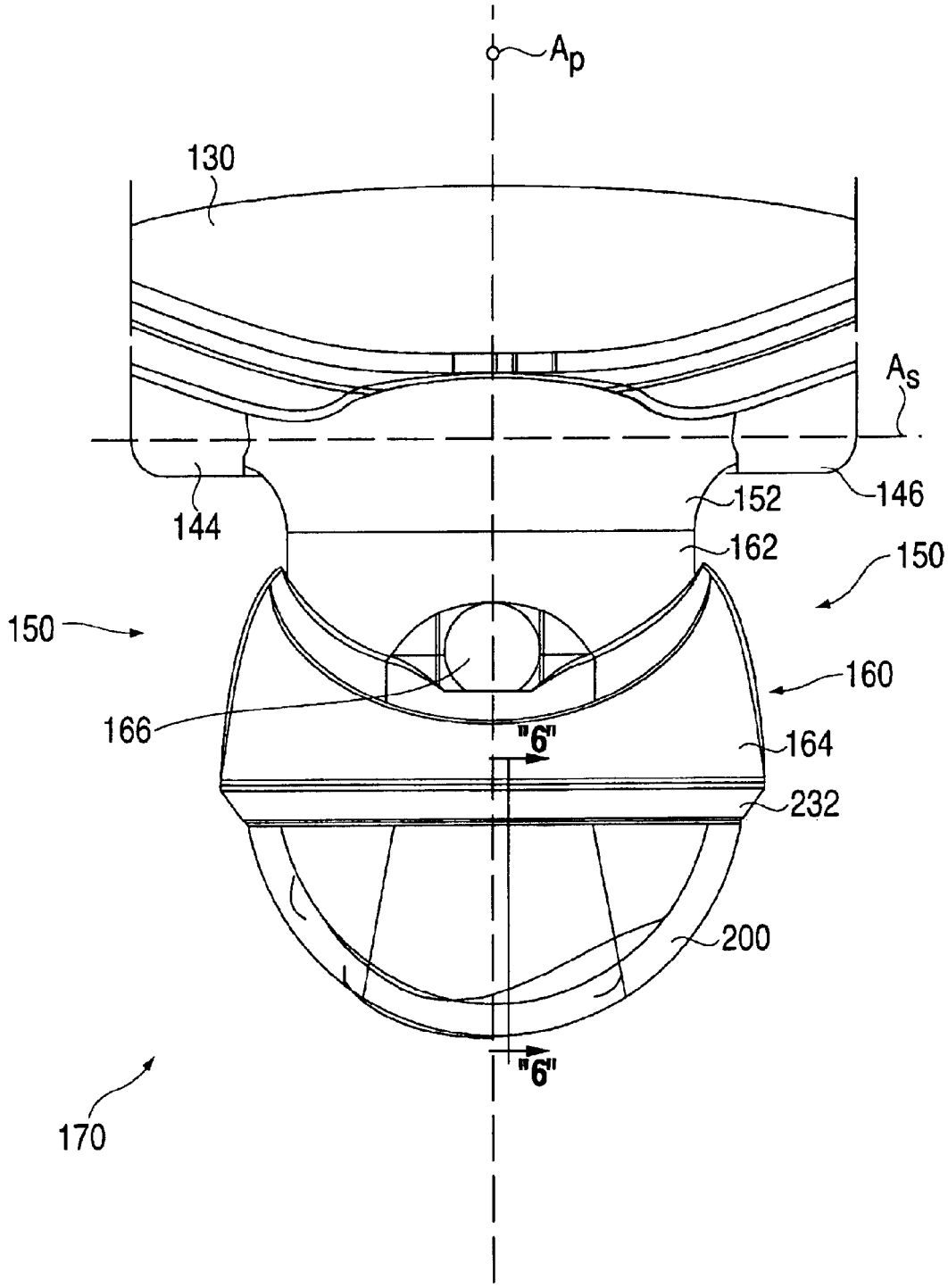
FIG. 4 illustrates a front view of some of the components of the infant support structure of FIG. 2.

As illustrated in FIGS. 2–4, the infant support structure 100 includes a connection assembly 150 that is coupled to the housing 130. The connection assembly 150 can be referred to alternatively as a connector. The infant support structure 100 also includes a support 250 that is coupled the connection assembly 150. The connection assembly 150 includes several components that move relative to the frame 102, thereby enabling the support 250 to move relative to the frame 102. An exemplary connection assembly is disclosed in U.S. Pat. No. 5,803,817, entitled "Infant Swing," issued Sep. 8, 1998, the disclosure of which is incorporated herein by reference in its entirety.

In the illustrated embodiment, the support 250 includes a support or hanger arm 252 and a support area or seat 254. The upper end of the support arm 252 is fixedly coupled to a portion of the connection assembly 150. The lower end of the support arm 252 is coupled to the seat 254. While a single support arm 252 is illustrated, the infant support structure may include multiple support arms in alternative embodiments.

In the illustrated embodiment, the seat 254 is pivotally coupled to the support arm 252. The seat 254 includes a recline mechanism (not shown) that can be manipulated to adjust the inclination of the seat 254 relative to the support arm 252. An exemplary seat and recline mechanism is disclosed in U.S. Pat. No. 6,027,409, entitled "Children's Reclineable Swing Seat," issued Feb. 22, 2000, the disclosure of which is incorporated herein by reference in its entirety.

In one embodiment, the seat 254 includes a tray 256. The tray 256 can be detachably coupled to the seat 254. The upper surface of the tray 256 includes openings into which ends of a bar 258 can be inserted. The bar 258 can include several characters 260 slidably mounted thereon.

A side view of an embodiment of a connection assembly according to the invention is illustrated in FIG. 4. In this embodiment, the connection assembly 150 includes an upper housing 152 and a lower housing 160. The lower housing 160 includes an upper portion 162 and a lower portion 164 that are coupled to each other.

The connection assembly 150 is pivotably mounted to the housing 130. As illustrated in FIG. 4, the housing 130 includes support portions 144 and 146 that define openings in which parts of the upper housing 152 are supported for movement. The upper housing 152 is pivotally coupled to the housing 130 and pivots about an axis As. The support structure 100 includes a conventional drive mechanism (not shown) disposed in the housing 130 that moves the upper housing 152 relative to the housing 130. The upper housing 152 and the seat 254 move back and forth along the directions of arrow "A" as shown in FIG. 2.

The lower housing 160 is pivotable relative to the upper housing 152 about a vertical pivot axis $A_p$ (see FIG. 4). The lower housing 160 includes an actuator 166 that can be pressed inwardly to activate an internal release mechanism (not shown) that enables the lower housing 160 to rotate relative to the upper housing 152. The lower housing 160 can be rotated approximately 90°.

As the lower housing 160 rotates, the orientation of the support 250 changes relative to the frame 102. The support 250 can be disposed so that the seat 254 is in a first orientation in which it travels in a side-to-side direction (see FIG. 2) or in a second orientation in which it travels in a front-to-rear direction (see FIG. 3).

Referring to FIGS. 2–3, the infant support structure 100 includes an entertainment device 170. In the illustrated embodiment, the entertainment device 170 includes a toy aquarium 200. In another embodiment, the entertainment device 170 includes a mobile 300.

As illustrated in FIG. 2, the entertainment device 170 is supported on the infant support structure 100. The entertainment device 170 is disposed so that an infant supported on the structure 100 can see the entertainment device 170.

As illustrated in FIG. 4, the entertainment device 170 includes a toy aquarium 200. The toy aquarium 200 is configured to be coupled to the connection assembly 150. In particular, the toy aquarium 200 is coupled to the lower end of the lower portion 164 of the connection member 150. In alternative embodiments, the entertainment device may be attached directly to the housing or to a support frame using any conventional technique, such as straps, fasteners, friction, adhesive, etc.

Figure 5:
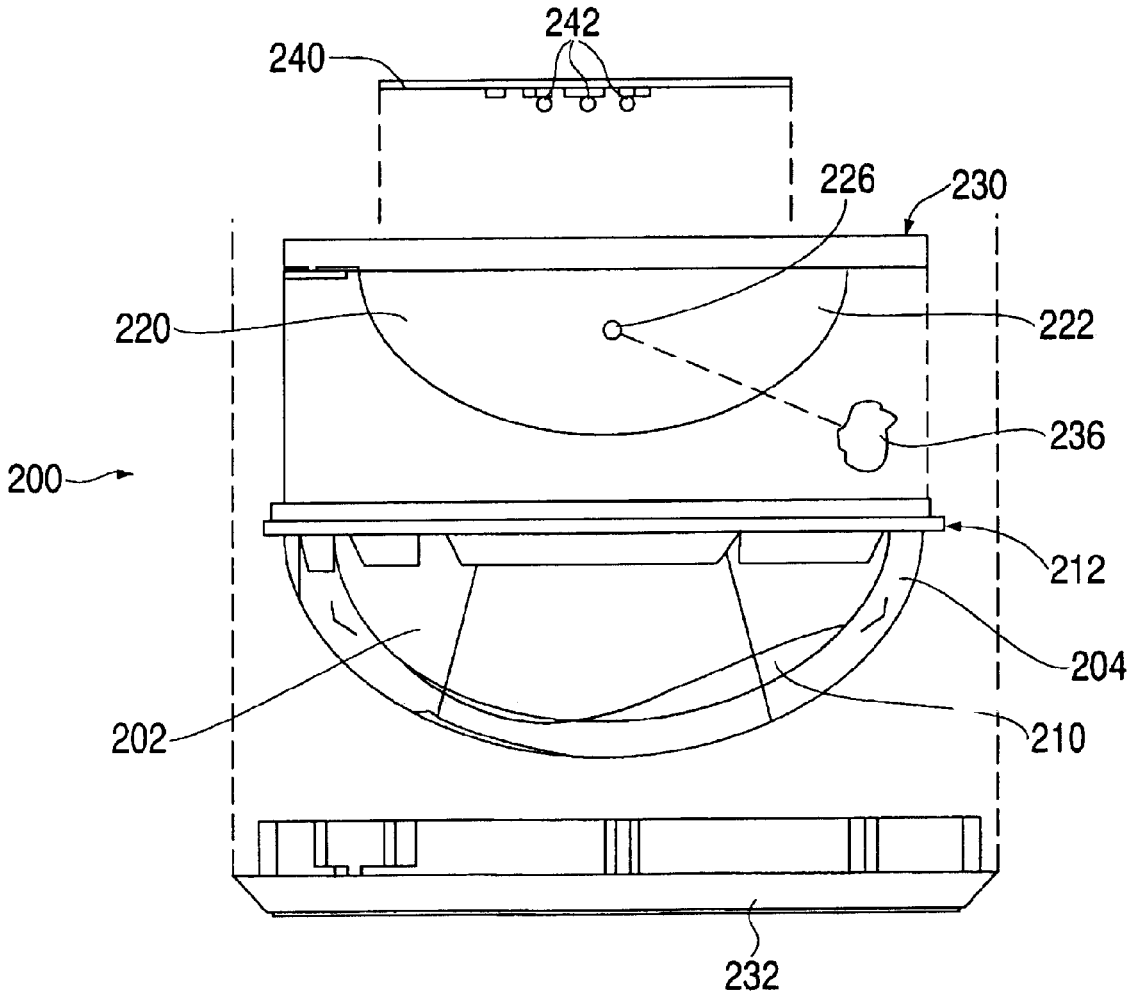
FIG. 5 illustrates an exploded side view of some of the components of an embodiment of an entertainment device according to the invention.

An exploded view of relevant components of the toy aquarium 200 are illustrated in FIG. 5. The toy aquarium 200 includes an outer member 202 and an inner member 220. As illustrated, each of the outer member 202 and the inner member 220 has a hemispherical configuration.

The toy aquarium 200 includes a mounting ring 232 that couples the outer member 202 and the inner member 220 to the lower end of the connection assembly 150. As illustrated in FIG. 4, the mounting ring 232 engages the lower end of lower portion 164. The mounting ring 232 is coupled to the lower portion 164 via fasteners. In alternative embodiments, the mounting ring 232 includes several resilient tabs that engage corresponding openings on the lower portion 164 to mount the mounting ring 232. In other embodiments, the mounting ring 232 can be coupled to the lower portion 164 via any conventional technique, such as an adhesive, a friction connection, etc.

Figure 6:
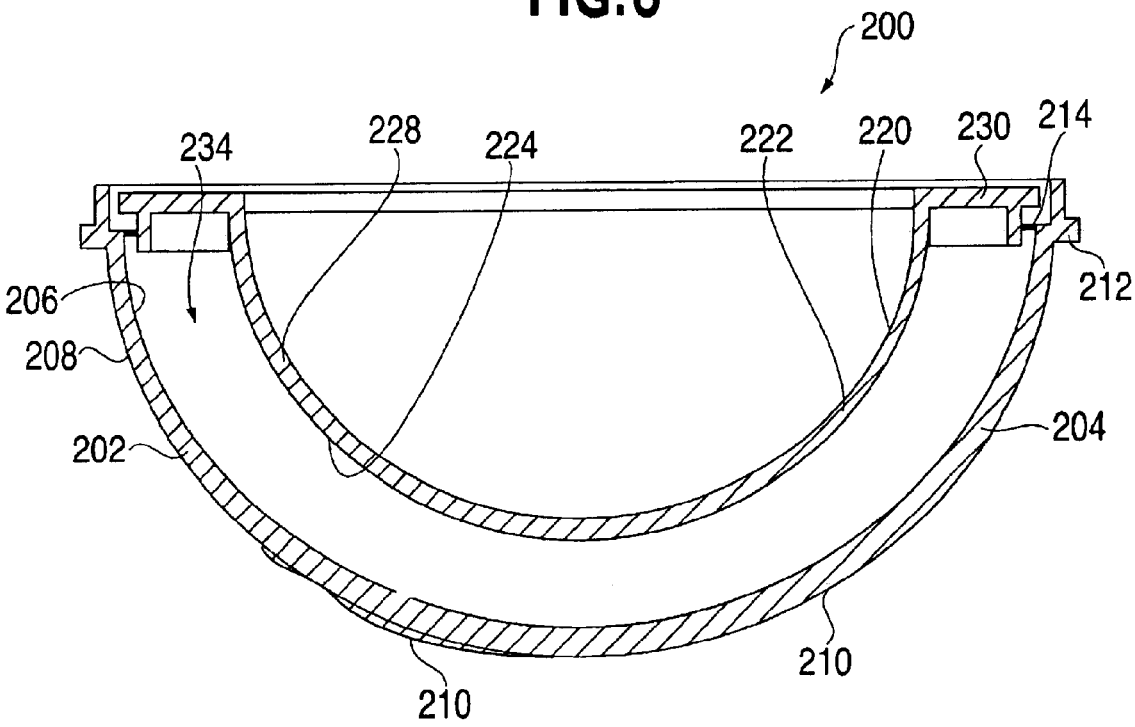
FIG. 6 illustrates a cross-sectional side view of the entertainment device taken along the lines "6—6" in FIG. 4.

As illustrated in FIGS. 5 and 6, the outer member 202 includes a curved body portion 204 and a flange 212 extending around a perimeter of the body portion 204. The body portion 204 includes an inner surface 206 and an outer surface 208. The outer surface 208 includes several raised portions or details 210 that are formed thereon. The details 210 can have any shape or configuration. For example, the details 210 can have aquatic-themed configurations. The outer member 202 is made of a transparent material, such as plastic.

The inner member 220 includes a curved body portion 222 and a flange 230 extending around a perimeter of the body portion 222. The body portion 222 includes an outer surface 224 and an inner surface 228. The outer surface 224 includes several protrusions 226 extending outwardly therefrom (only one is shown in FIG. 5). The protrusions 226 are spaced apart along the outer surface 224 and are formed integrally with the body portion 222. In an alternative embodiment, the protrusions 226 may be formed separately and coupled to the body portion 222. The inner member 220 is made of a translucent material that allows light to pass therethrough. The inner member 220 can be a color lens, such as a blue lens.

As illustrated in FIG. 5, the toy aquarium 200 includes a plate 240 that supports several illumination devices 242, such as grain of wheat bulbs or LEDs. The plate 240 is located above the inner member 220. The illumination devices 242 are mounted to the plate 240. In one implementation, the illumination devices 242 are inserted into and retained in holes formed in the plate 240. Light from the devices 242 illuminates and passes through the inner member 220 and the outer member 202.

In one embodiment, each of the devices 242 is a different color. In another embodiment, one or more of the devices 242 fades in and out. In another embodiment, one or more of the devices 242 changes colors using lens. In one embodiment, a rotating colored wheel can be used to vary the output. A diffuser (not shown) may be used with the devices 242. The diffuser can be used to soften the light viewed by the infant supported on the support structure 100.

A cross-sectional view of the toy aquarium 200 is illustrated in FIG. 6. The inner member 220 and the outer member 202 form a container that defines a chamber 234. The chamber 234 is the area between the outer surface 224 of the inner member 220 and the inner surface 206 of the outer member 202. The chamber 234 is configured to contain a fluid, such as a water/glycol mixture. In one embodiment, the fluid can include particles such as suspended translucent beads and/or glitter disposed therein. The beads and glitter diffract the light.

When the inner member 220 and the outer member 202 are placed proximate to each other, the flanges 230 and 212 are positioned adjacent each other. In one embodiment, a sealing ring 214 is located between the flanges 212 and 230 to seal the chamber 234 when the outer member 202 and the inner member 220 are held next to each other by the mounting ring 232.

In the illustrated embodiment, the entertainment device 200 includes several toy characters 236 (only one is shown in FIG. 5) in the chamber 234. Character 236 is mounted on a protrusion 226 formed on the outer surface 224 of the inner member 220. The character 236 can include a recess or a through hole that is configured to receive the protrusion 226. In an alternative embodiment, the character can have any type of connection or mounting structure. In an alternative embodiment, one or more of the characters 236 can be float freely in the fluid in the chamber 234.

When the support 250 moves relative to the frame 102, the entertainment device 170, including the toy aquarium 200, moves with the support 250. Motion is imparted to any movable components in the toy aquarium 200, such as the fluid and/or toy characters, as the support 250 moves. The movement of the fluid and/or toy characters creates a mesmerizing and/or relaxing effect to soothe an infant supported on the support structure 100. Also, changes to the illumination devices 242, such as turning them on and off, fading in and out, and/or color changes, creates additional relaxing effects.

The support structure 100 includes an output generating system, which is disposed in the housing 130. The output generating system controls the operation of the illumination devices. For example, the output generating system can be manipulated so that the lights are turned on or off or fade in or out.

The output generating system can generate various audible outputs via a transducer, such as a speaker. For example, the outputs can include soothing sounds, such as rain, waves, and a babbling brook. The outputs can also include songs. One or more switches are provided on the control panel 132 to enable a user to select the particular audible output desired. The audible outputs are stored in a conventional memory of the output generating system.

Figure 7:
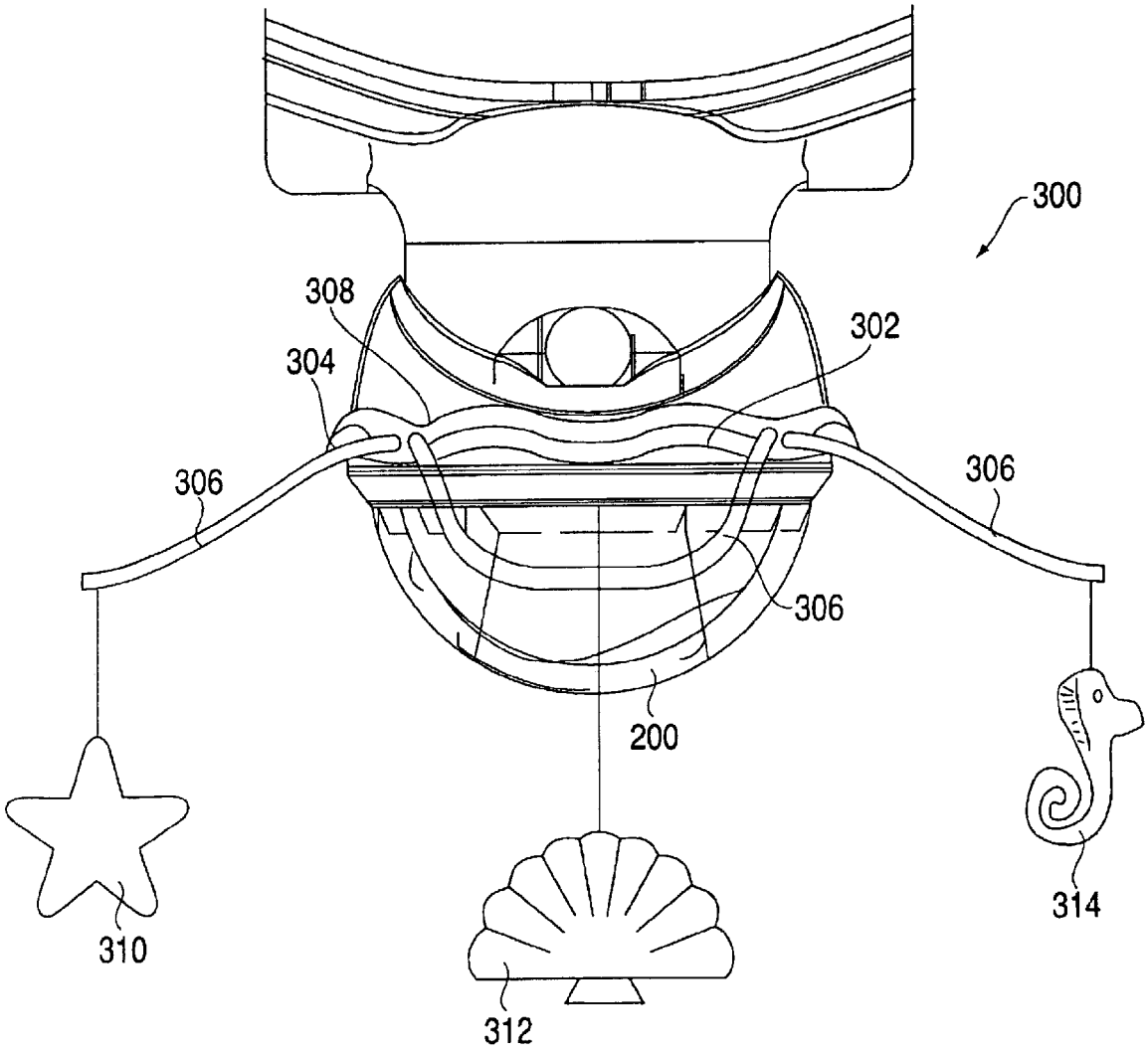
FIG. 7 illustrates a front view of an alternative embodiment of an entertainment device according to the invention.

An alternative embodiment of an entertainment device is illustrated in FIG. 7. In this embodiment, the entertainment device includes a mobile 300 and a toy aquarium 200. The mobile 300 includes a driven ring 302 that is engaged by a drive ring (not shown) to which motion is imparted by motor (not shown). Each of the driven ring 302 and the drive ring include cooperating teeth that engage each other to move the mobile 300.

The mobile 300 includes a character support structure 304 that has several loops 306 from which toy characters are suspended. The character support structure 304 includes an inner ring portion 308 that is supported on the driven ring 302. In one embodiment, each of the driven ring 302 and the inner ring portion 308 has a wave-like structure that engages the wave-like structure of the other to couple them together for movement. The structures are such that the driven ring 302 and the inner ring portion 308 can separate from each other if movement of the character support structure 304 is impeded.

The character support structure 304 has several suspended characters 310, 312 and 314 that are located over the seat 254. As the driven ring 302 moves, the character support structure 304 moves as well.

An alternative embodiment of an infant support structure is illustrated in FIGS. 8–11. This embodiment of an infant support structure is related to the structure disclosed in U.S. Pat. No. 6,520,862, entitled "Collapsible Infant Swing," issued Feb. 18, 2003, the entire disclosure of which is incorporated herein by reference.

In this embodiment, the infant support structure 400 includes a frame 410 with an upper portion 412 and a lower portion 414. The lower portion 414 is configured to be supported on a support surface. The upper portion 412 includes a pair of legs that are coupled together via a cross member 416.

The infant support structure 400 includes support arms 420 and 422 that are pivotally coupled to the cross member 416 and driven by a motor (not shown). In this embodiment, support arms 420 and 422 have a curved configuration. In alternative embodiments, the support arms 420 and 422 may have any shape or configuration.

The infant support structure 400 includes a support 430 that is coupled to the support arms 420 and 422. The support 430 includes a seat 432 that is configured to support an infant.

Support arm 420 includes an opening 424 formed therein. Opening 424 extends through the support arm 420. Similarly, support arm 422 includes an opening 426 formed therein. Opening 426 extends through the support arm 422. In alternative embodiments, the openings 424 and 426 do not extend through the support arms.

The infant support structure 400 includes an entertainment device 440 coupled to support arm 420. In this embodiment, the entertainment device 440 is a toy aquarium. The entertainment device 440 includes an inner cover 442 and an outer cover 444 that define a chamber or container therebetween. The inner cover 442 and outer cover 444 can be coupled together using any technique.

Figure 11:
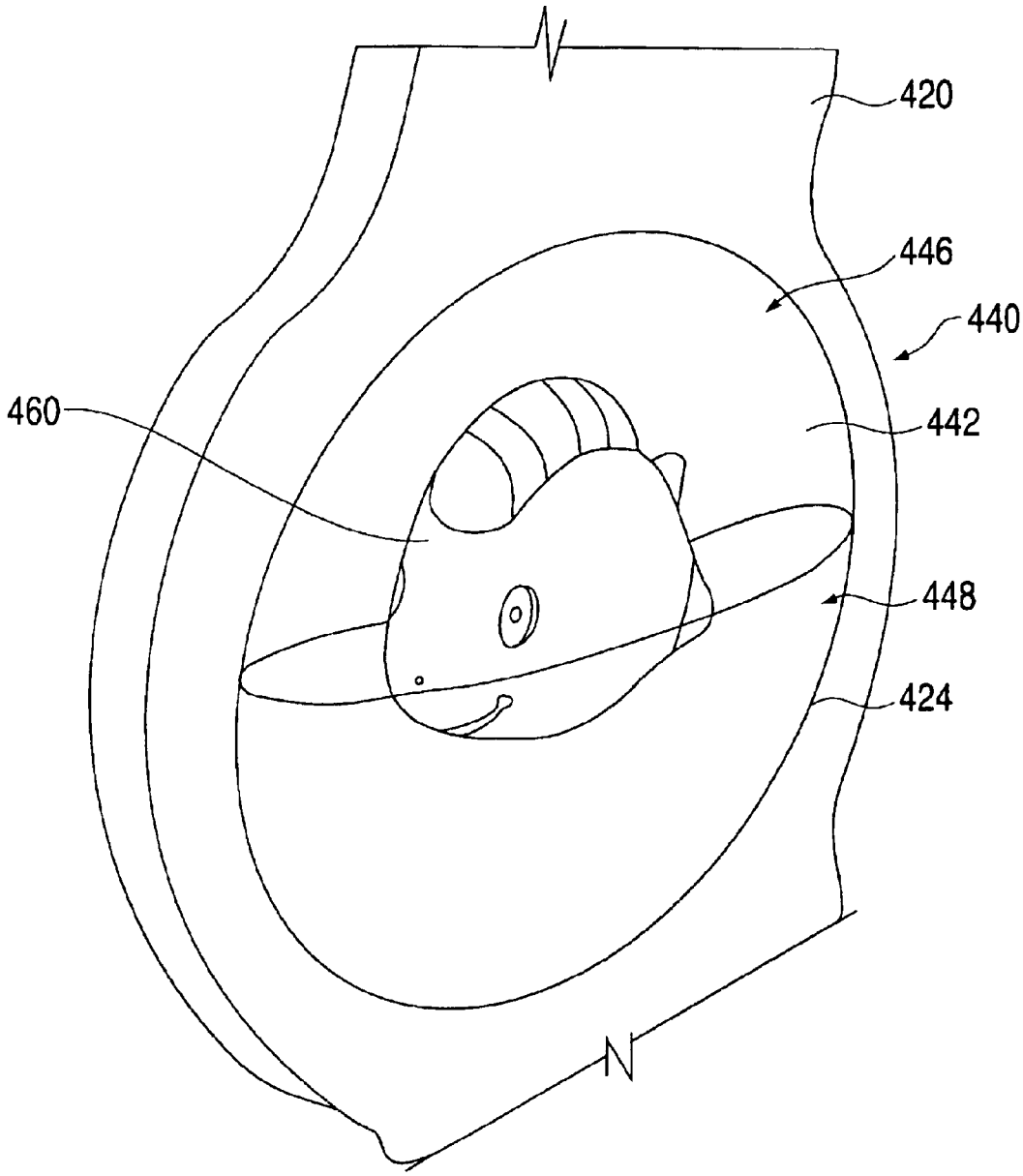
FIG. 11 illustrates a front perspective view of an embodiment of an entertainment device of the infant support structure of FIG. 8.

Referring to FIG. 11, the entertainment device 440 is disposed in the opening 424 formed in support arm 420. The entertainment device 440 includes two fluids 446 and 448 that have different densities, which cause them to separate into two layers. In one embodiment, fluid 446 is oil and fluid 448 is water. Each of the fluids 446 and 448 can be referred to as a movable component.

The entertainment device 440 includes a toy character 460 that is disposed in the fluids. The toy character 460 can have any shape or configuration. In this embodiment, the toy character 460 is an aquatic-themed character, such as a fish, and has a density between that of oil and water, thereby causing the toy character 460 to float freely between the fluids 446 and 448.

In alternative embodiments, any number of objects, such as multiple characters, glitter, beads, etc., can be disposed in the fluids 446 and 448. In an alternative embodiment, the entertainment device may include a single fluid.

Figure 8:
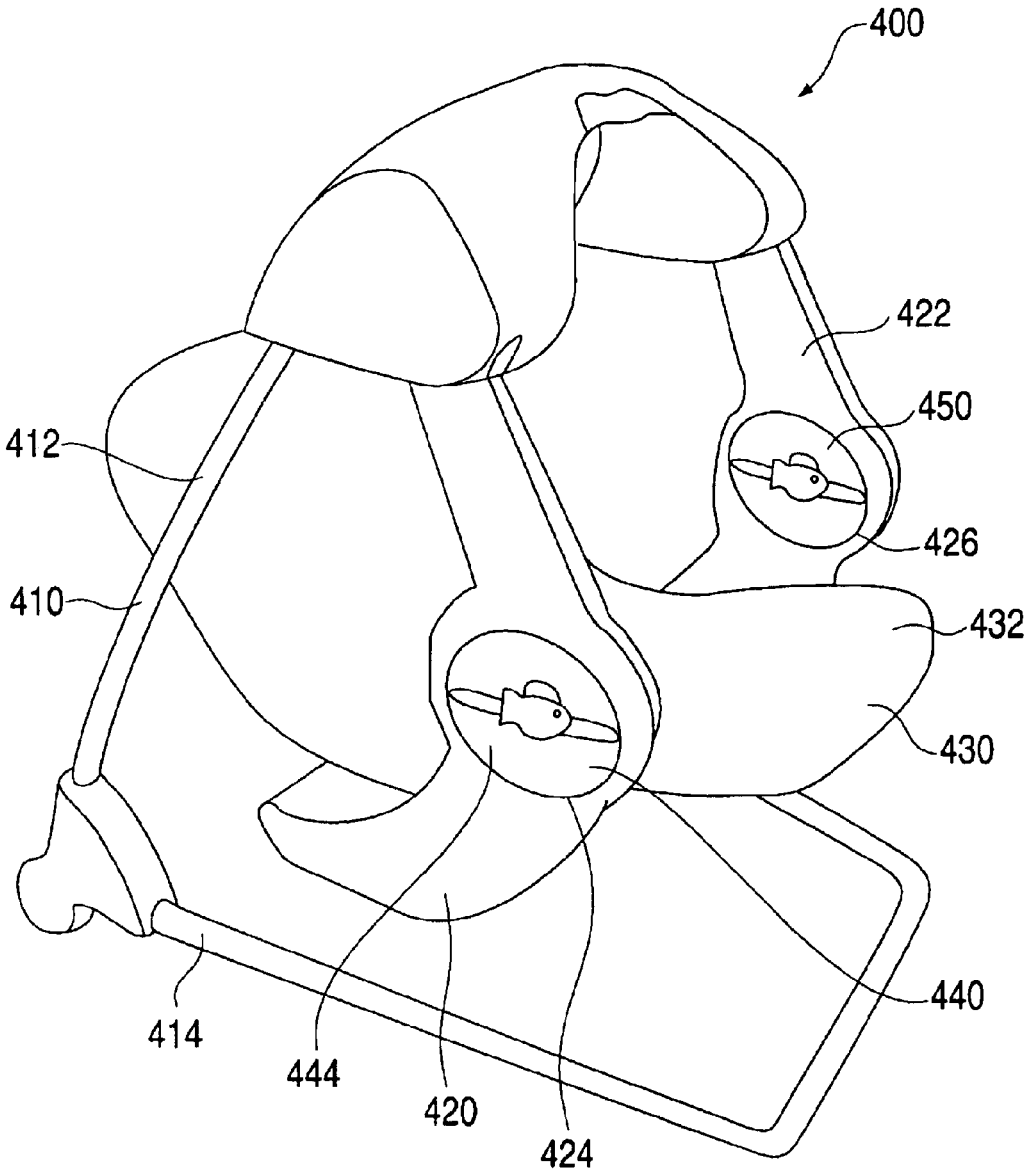
FIG. 8 illustrates a front perspective view of an alternative embodiment of an infant support structure according to the invention.
Figure 9:
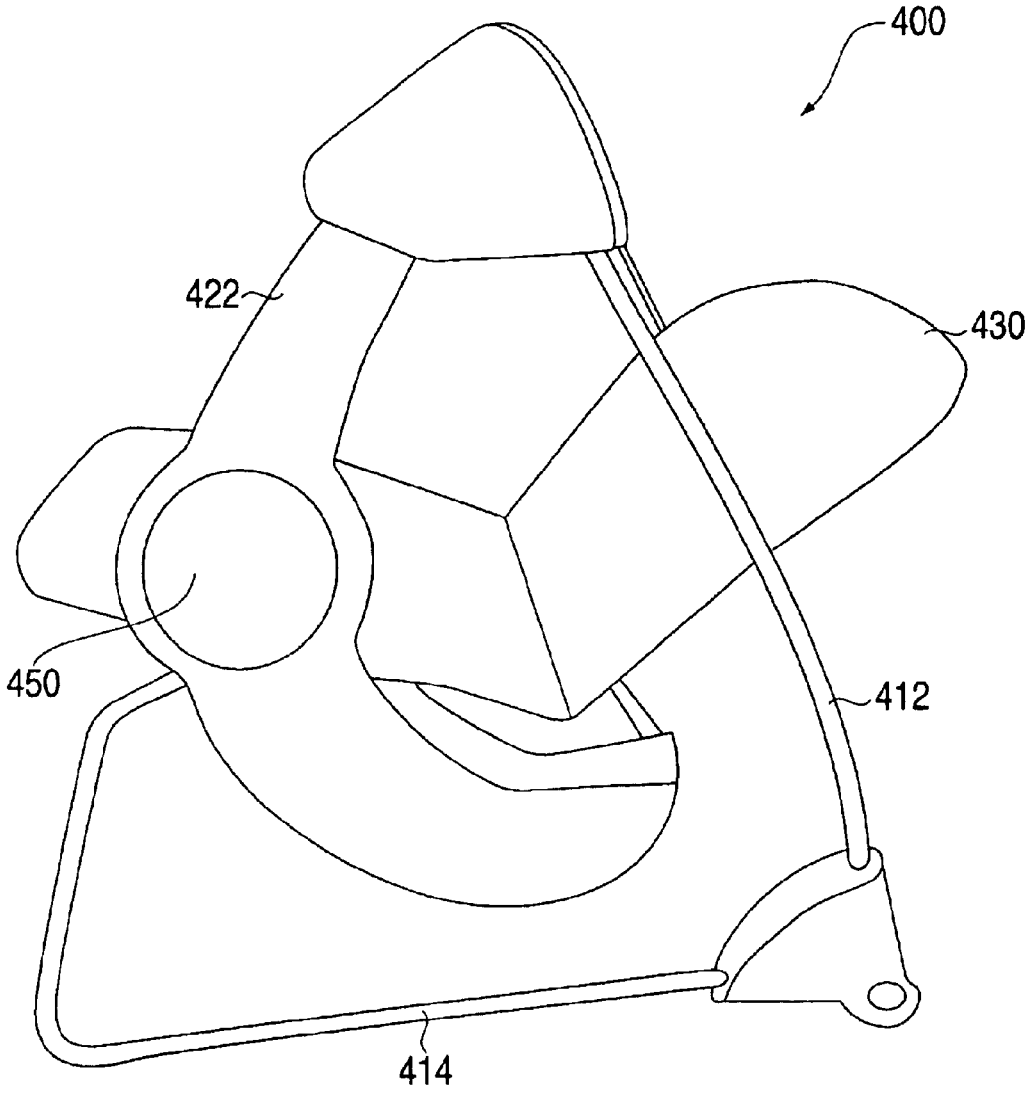
FIG. 9 illustrates a side view of the infant support structure of FIG. 8.
Figure 10:
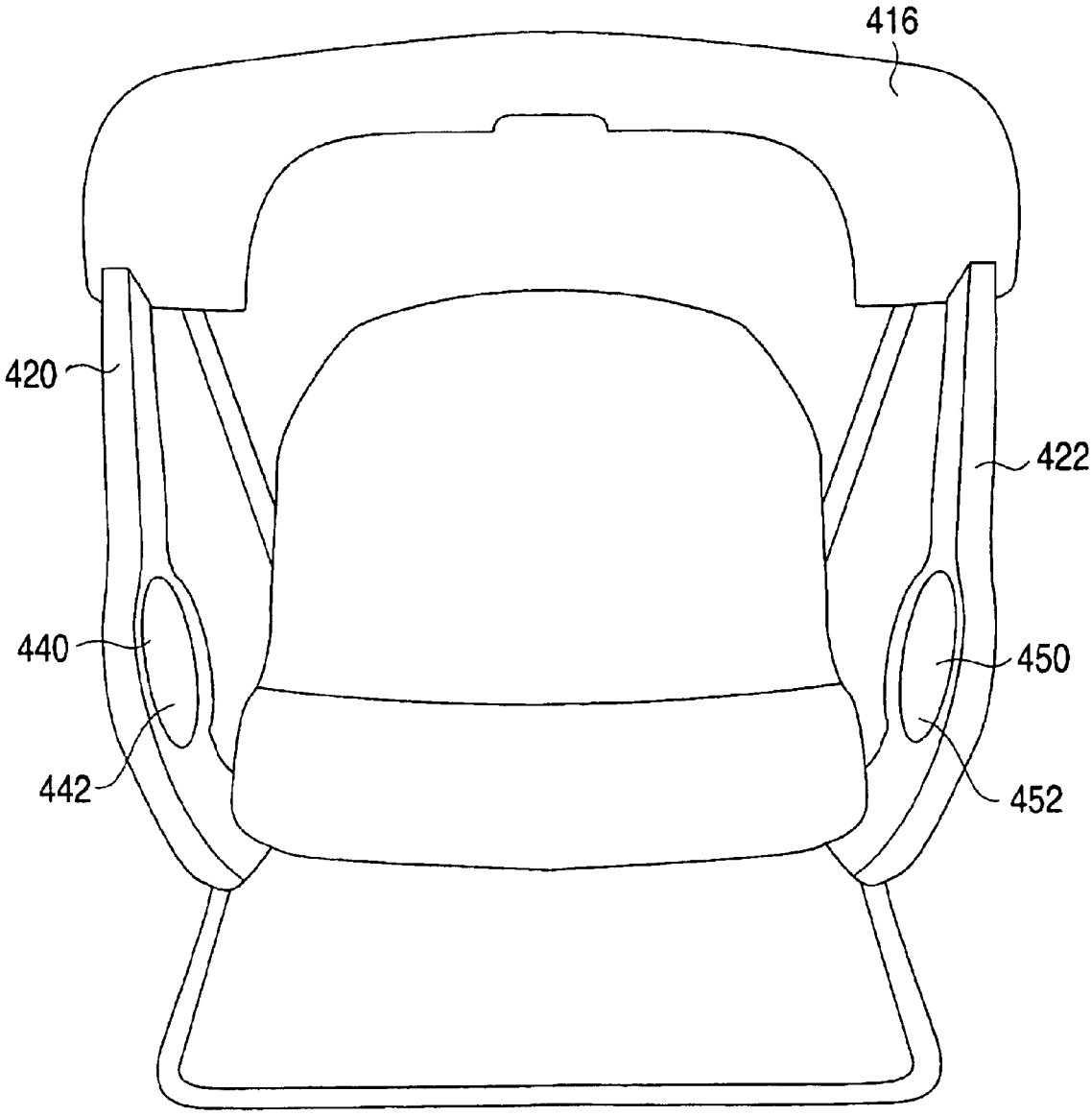
FIG. 10 illustrates a front view of the infant support structure of FIG. 8.

Referring to FIG. 8, the infant support structure 400 includes an entertainment device 450 coupled to support arm 422. In this embodiment, the entertainment device 450 is a toy aquarium and contains the same components as entertainment device 440. In an alternative embodiment, entertainment devices 440 and 450 do not have to be in the same location on the support structure nor do they need to include the same elements.

As the support arms 420 and 422 and the support 430 move relative to the frame 410 and the support surface, motion is imparted to the movable components of the entertainment devices 440 and 450. In particular, the toy characters float in the fluids as the fluids move.

In an alternative embodiment, the infant support structure 400 may include only one of the entertainment devices in one of the support arms.

In alternative embodiments, any number of characters can be included in the toy aquarium and/or suspended from the character support structure 304. The characters can be any type of characters, including animals, persons, structures, vehicles, etc. and can be either stuffed or molded characters.

As previously discussed, the infant support structure can be any type of infant support structure. In alternative embodiments, the infant support structure can be a bouncer, a high chair, a stroller, a swing, or any other structure that can be used to support an infant.

In alternative embodiments, the toy aquarium can have any shape or configuration. Moreover, the inner member and the outer member of the toy aquarium can have any shape or configuration.

In alternative embodiments, each entertainment device can be coupled to a different location on the infant support structure. The entertainment devices of an infant support structure can be coupled at any combination of various locations on the infant support structure, including on a tray, formed in a tray, to a support arm (which can include a plastic support arm or a tubular member), on a support arm, or any movable structure of the infant support structure.

In an alternative embodiment, the covers that form a chamber for the entertainment device may have any shape or configuration.

While the invention has been described in detail and with reference to specific embodiments thereof, it will be apparent to one skilled in the art that various changes and modifications may be made therein without departing from the spirit and scope thereof. Thus, it is intended that the invention covers the modifications and variations of this invention provided they come within the scope of the appended claims and their equivalents.

What is claimed is:

1. An infant swing comprising:

a frame;

a connector coupled to the frame, the connector being mounted for movement relative to the frame;

a support coupled to the connector, the support being configured to support an infant, the support being configured for movement with the connector; and an entertainment device coupled to the connector, wherein the entertainment device is a toy aquarium, the toy aquarium includes a chamber and a toy character, the chamber having a fluid disposed therein, the toy character being disposed within the chamber, the toy aquarium further includes an outer member and an inner member, the outer member and inner member defining the chamber therebetween, each of the outer member and the inner member has a hemispherical configuration.

2. The infant swing of claim 1, wherein the toy character is coupled to the inner member.

3. The infant swing of claim 1, wherein the toy aquarium includes a light source, the light source being disposed proximate to the inner member and the light from the light source passes through the inner member and the outer member.

4. The infant swing of claim 1, wherein at least one of the toy character and the fluid moves when the connector moves relative to the frame.

5. The infant swing of claim 4, wherein the inner member includes a body portion with a protrusion coupled thereto, and the toy character is pivotably mounted on the protrusion.

6. The infant swing of claim 1, further comprising:

an output generating system, the output generating system including a plurality of lights and a transducer, the output generating system being configured to control the operation of the plurality of lights and to control the transducer to produce an audible output.

7. The infant swing of claim 1, wherein the entertainment device includes a mobile coupled to the connector, the mobile being configured to rotate relative to the connector.

8. The infant swing of claim 1, wherein the connector is pivotably coupled to the frame, the connector has an upper housing and a lower housing, the upper housing being coupled to the frame, and the entertainment device being coupled to the lower housing.

9. The infant swing of claim 8, wherein the toy aquarium includes an outer member and an inner member defining a chamber therebetween, each of the inner member and the outer member including a body portion and a flange portion, the flange portions of the outer member and the inner member being proximate to each other.

10. The infant swing of claim 1, wherein the support includes a seat configured to support an infant, the entertainment device being located substantially above the seat.

11. The infant swing of claim 1, wherein the support includes a hanger arm and a seat, the hanger arm being fixedly coupled to the connector, and the seat being coupled to the hanger arm.

12. A child swing comprising:

a frame;

a support portion coupled to the frame, the support portion being configured to move with respect to the frame; and an entertainment device coupled to the support portion, the entertainment device including a chamber and a movable component disposed therein, the movable component being configured to move as said support portion moves relative to the frame, the support portion includes a support arm and a seat coupled to the support arm, and the entertainment device is coupled to the support arm, the support arm includes an opening and a portion of the entertainment device is disposed in the opening.

13. The child swing of claim 12, wherein the movable component is one of a fluid and a toy character.

14. The child swing of claim 12, wherein the entertainment device includes a toy character and a fluid disposed in the chamber, the toy character being disposed in the fluid, the toy character being configured to move in response to the motion of the support portion relative to the frame.

15. The infant swing of claim 14, wherein the support portion includes a support area configured to support an infant, the entertainment device being located substantially above the support area.

16. The infant swing of claim 15, wherein the entertainment device has an upper end and a lower end, the upper end of the entertainment device is coupled to the frame, and the entertainment device is suspended from the frame.

17. The infant swing of claim 12, wherein the support arm is a first support arm and the support portion includes a second support arm, the seat is coupled to the first and second support arms, the entertainment device is a first entertainment device, the first entertainment device being coupled to the first support arm, the infant swing further comprising:

a second entertainment device, the second entertainment device including a fluid and a movable member disposed in the fluid, the second entertainment device being coupled to the second support arm.

18. An infant support structure comprising:

a frame;

a seat, the seat being coupled to the frame for movement relative thereto;

a container, the container being configured to be coupled to the frame, the container including a first member and a second member, the first member and the second member defining a chamber therebetween; and a fluid disposed in the chamber, wherein movement of the seat causes movement of the fluid in the chamber; and an output generating system, the output generating system being configured to generate at least one of a visual output and an audio output.

19. The infant support structure of claim 18, wherein each of the first member and the second member includes a body portion and a flange portion, the first member and the second member defining the chamber when the flange portions are positioned proximate to each other.

20. The infant support structure of claim 18, wherein the frame includes a support arm with an opening defined therein, the seat being coupled to the support arm, and the container being disposed in the opening in the support arm.

21. An infant swing comprising:

a frame;

a connection assembly, the connection assembly being pivotally coupled to the frame for movement relative thereto;

a seat, the seat being coupled to the connection assembly;

a toy aquarium, the toy aquarium being coupled to the connection assembly, the toy aquarium including a first member and a second member forming a container, the container defining therein a chamber, the first member and the second member each having a curved body portion, the toy aquarium including a fluid disposed in the chamber and a toy character disposed in the fluid, wherein movement of the seat causes movement of the fluid and the toy character; and an output generating system, the output generating system including a light source and an audio transducer.

22. An infant swing comprising:

a frame;

a first support arm, the first support arm pivotally coupled to the frame;

a second support arm, the second support arm pivotally coupled to the frame;

a seat, the seat being coupled to the first support arm and the second support arm;

a first toy aquarium, the first toy aquarium being coupled to one of the first support arm and the second support arm, the first toy aquarium defining a chamber in which a fluid and a toy character are disposed, and movement of the first support arm, the second support arm and the seat causing movement of the fluid and the toy character; and a second toy aquarium, wherein the first support arm includes an opening, the second support arm includes its own opening, the first toy aquarium being disposed in the opening of the first support arm, the second toy aquarium being disposed in the opening of the second support arm.

* * * * *